US006213795B1

(12) United States Patent
Drescher et al.

(10) Patent No.: US 6,213,795 B1
(45) Date of Patent: Apr. 10, 2001

(54) TWO-PART ELECTRICAL CONNECTOR

(75) Inventors: Thomas Drescher, Remscheid; Oliver Hackel; Peter Schekalla, both of Wuppertal, all of (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/395,815

(22) Filed: Sep. 14, 1999

(30) Foreign Application Priority Data

Sep. 29, 1998 (DE) ..... 198 44 693

(51) Int. Cl.[7] ..... H01R 13/62; H01R 13/625; H01R 4/50; H01R 13/627; H01R 13/64

(52) U.S. Cl. ..... 439/157; 439/152; 439/157; 439/345; 439/352; 439/372

(58) Field of Search ..... 439/153, 152, 439/157, 154, 155, 156, 345, 347, 352, 372

(56) References Cited

U.S. PATENT DOCUMENTS

| | | | |
|---|---|---|---|
| 5,672,067 | 9/1997 | Ryll et al. | 439/157 |
| 5,681,175 | 10/1997 | Busse et al. | 439/157 |
| 5,873,745 | 2/1999 | Duclos et al. | 439/157 |
| 5,876,226 | 3/1999 | Tsukakoshi et al. | 439/157 |
| 5,899,762 | 5/1999 | Ainceri | 439/157 |
| 5,938,458 | 8/1999 | Krehbiel et al. | 439/157 |

FOREIGN PATENT DOCUMENTS

| | | |
|---|---|---|
| 198 08 684 A1 | 9/1998 | (DE) . |
| 0 606 967 A2 | 7/1994 | (EP) . |
| 06 606 151 A2 | 7/1994 | (EP) . |
| 07 22 203 A1 | 7/1996 | (EP) . |
| 0 855 763 A2 | 7/1998 | (EP) . |

*Primary Examiner*—Paula Bradley
*Assistant Examiner*—Edwin A. León
(74) *Attorney, Agent, or Firm*—Richard A. Jones

(57) ABSTRACT

An electrical connector (10) comprising a first part (12) including a housing (16) having opposed side walls (18,20) each having an upper wall (24) and a lower wall (26) defining opposed slide surfaces (28) extending in a direction (Y) substantially perpendicular to the mating axis. Each side wall (34,36) includes first and second spaced apertures (34,36) and an upward extension (70). A slider (30,31) is positioned adjacent each side wall and includes a pair of inclined cam surfaces (46) having openings (48) alignable with the apertures in the lower wall, and a resilient tab (52) for making a snap fit in the first aperture in a fully unmated position or the second aperture in a fully mated position. A substantially U-shaped lever (58) having a pair of arms (60) and pivot means (62,72) on each arm allowing the lever to pivot relative to the housing. Drive means (66,74;68,80) on each arm and each slider slide each slider relative to the adjacent side wall on pivoting of the lever relative to the housing. A second part (14) including a housing (106) having side walls (108) each having a pair of spaced cam followers (112) which can pass through the apertures in the lower walls and the openings in the inclined cam surfaces for sliding movement along the cam surfaces.

9 Claims, 5 Drawing Sheets

TWO-PART ELECTRICAL CONNECTOR

TECHNICAL FIELD

The present invention relates to a two-part electrical connector in which a lever is used for mating and unmating of the two parts.

BACKGROUND OF THE INVENTION

A two-part electrical connector with a lever for mating and unmating of the two parts is disclosed in EP-A-0722203. The lever is substantially U-shaped and is pivotally mounted on the housing of one part of the connector. A pair of sliders are also mounted on the same housing and slide on pivoting of the lever. The sliders have cam surfaces which engage corresponding cam followers on the housing of the other part of the connector. Pivoting of the lever causes the sliders to slide to mate or unmate the two parts of the connector. The pivot connection between the lever and the housing of the one part of the connector requires an arcuate slot in each arm of the lever.

SUMMARY OF THE INVENTION

The object of the present invention is to provide a two-part electrical connector which is an improvement of the above mentioned arrangement.

An electrical connector in accordance with the present invention comprises a first part mateable with a second part along an axis, the first part including a housing having opposed side walls and opposed end walls, each side wall having an upper wall and a lower wall defining opposed slide surfaces extending in a direction substantially perpendicular to the mating axis, first and second spaced apertures in each side wall, a pair of spaced apertures in the lower wall of each side wall, and an upward extension from the upper wall of each side wall; a slider positioned adjacent each side wall, each slider having an upper edge and a lower edge making a sliding engagement with the slide surfaces of the upper wall and the lower wall, respectively, of the side walls, a pair of inclined cam surfaces having openings in the lower edge alignable with the apertures in the lower wall of the side walls, and a resilient tab for making a snap fit in the first aperture or the second aperture in the side wall; a substantially U-shaped lever having a pair of arms; pivot means on each arm and each upward extension of each side wall to allow the lever to pivot relative to the housing of the first part; and drive means on each arm and each slider to slide each slider relative to the adjacent side wall on pivoting of the lever relative to the housing of the first part; the second part including a housing having side walls and end walls positionable inside the side walls and end walls of the housing of the first part, each side wall of the housing of the second part having a pair of spaced cam followers which can pass through the apertures in the lower walls and the openings in the inclined cam surfaces for sliding movement along the cam surfaces; pivoting movement of the lever moving the second part relative to the first part along the mating axis between a fully unmated position in which the tabs on each slider make a snap fit in the first aperture in the side walls and a fully mated position in which the tabs on each slider make a snap fit in the second aperture in the side walls.

Relative to the above mentioned prior known arrangement, the sliders are protected by the side walls, means are provided for holding the sliders in the fully mated and fully unmated positions, and there is no requirement for an arcuate slot in each arm of the lever.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
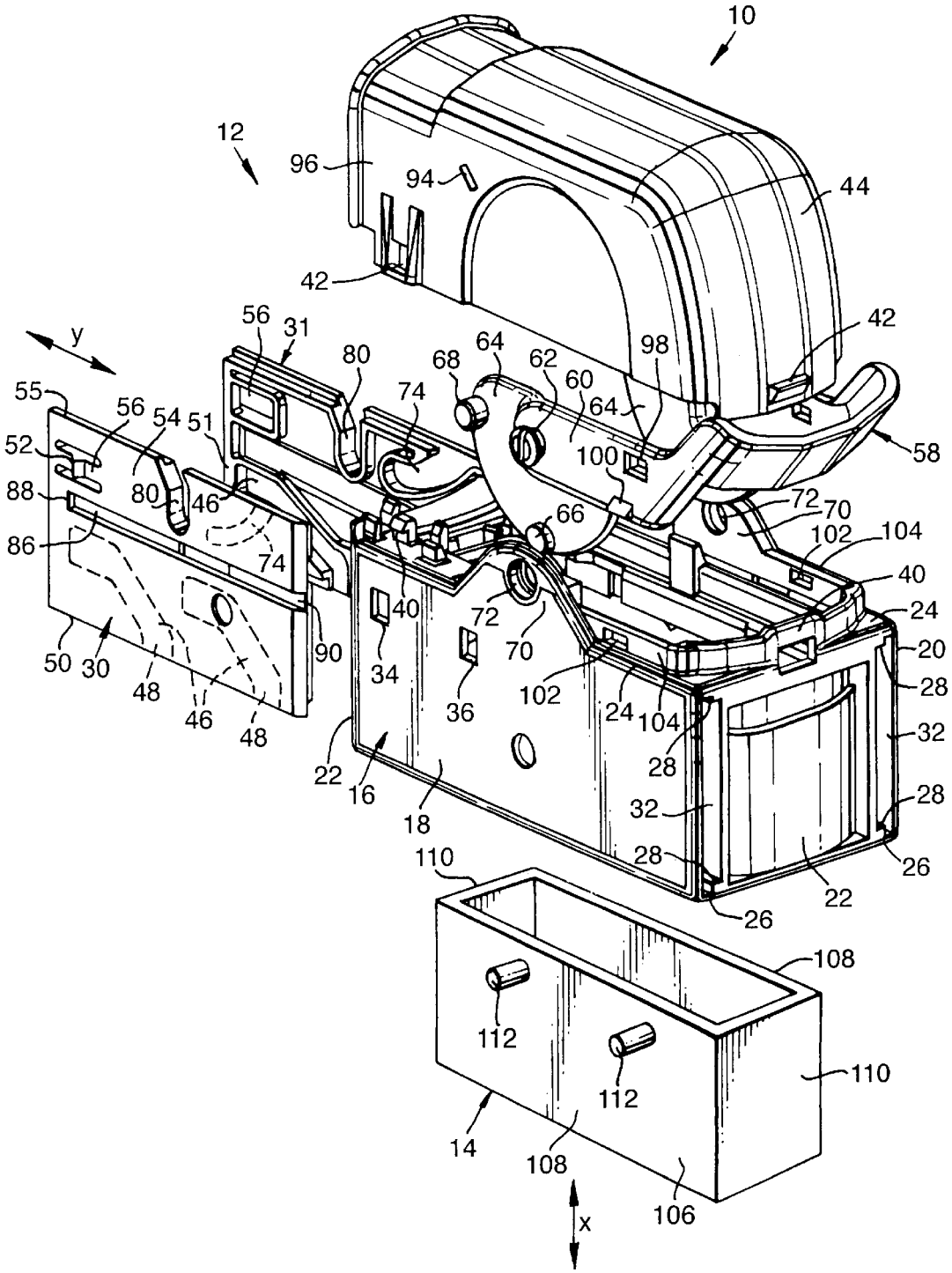
FIG. 1 is an exploded view of a two-part electrical connector in accordance with the present invention.

Referring now to FIG. 1 of the drawings, the two-part electrical connector 10 in accordance with the present invention comprises a first part 12 and a second part 14. Each part 12,14 is capable of receiving an retaining electrical contacts or terminals (not shown). On mating of the first and second parts 12,14, the contacts in the first part mate with, and complete an electrical connection with, the corresponding contacts in the second part. Any suitable type of contacts may be used. The first part 12 mates (mechanically and electrically connects) or unmates (mechanically and electrically disconnects) with the second part 14 by moving the parts relative to one another in an axial direction X.

The first part 12 of the connector 10 comprises a housing 16 of electrically insulating material, which is preferably plastics material, and which is preferably moulded in one piece. The housing 16 comprises first and second side walls 18,20 and end walls 22. Each side wall 18,20 has an upper wall 24 and a lower wall 26. The upper wall 24 and the lower wall 26 of each side wall 18,20 define, internally of the housing 16, slide surfaces 28 for a slider 30,31, respectively, positioned adjacent the side wall 18, 20. Each slide surface 28 extends in a direction Y which is substantially perpendicular to the mating axis X. Each slider 30,31 (which is preferably moulded in one piece from plastics material) is inserted into the housing 16 by way of slots 32 formed between the side walls 18,20 and the end walls 22. First and second spaced apertures 34,36 are formed in each side wall 18,20 and spaced apart in the direction Y. A pair of spaced apertures 38 are formed in the lower wall 26 of each side wall 18,20 and are spaced apart in the direction Y shown in FIG. 4. The upper wall 24 of each side wall 18,20 has latch means 40 on its outer surface which makes a snap fit with corresponding latch means 42 on a cover 44 of the first part 12 of the connector 10.

Each slider 30,31 has a pair of inclined channels 46 formed therein which open at an opening 48 through a lower edge 50 of the slider. The channels 46 are open sided and formed on the internal surface 51 of each slider 30,31. The openings 48 in each slider 30,31 have the same spacing as the apertures 38 in the lower wall 26 of the corresponding side wall 18,20, such that the openings 48 can align with the apertures 38. The channels 46 in each slider 30,31 are inclined in the same direction at the same angle and open inwardly towards the other slider. The channels 46 in each slider 30,31 are inclined in the same direction. A tab 52 is formed in the exterior surface 54 of each slider 30,31 either on a resiliently flexible beam 56, as shown, or on a resilient arm (not shown). Each tab 52 is capable of making a snap fit in the first aperture 34 or the second aperture 36 in the corresponding side wall 18,20. An upper edge 55 and the lower edge 50 of each slider 30,31 makes a sliding fit with the slide surface 28 of the upper wall 24 and the lower wall 26 of the corresponding side wall 18,20. Each slider 30,31 preferably has, in its external surface 54 a slot 86 which extends in the direction Y and which has a shoulder 88 at one end and is open at the other end 90. Each side wall 18,20 of the housing 16 has a tab 92, shown in FIG. 4, on its inner surface which can make a sliding fit in the slot 86 of the corresponding slider 30,31.

Figure 5:
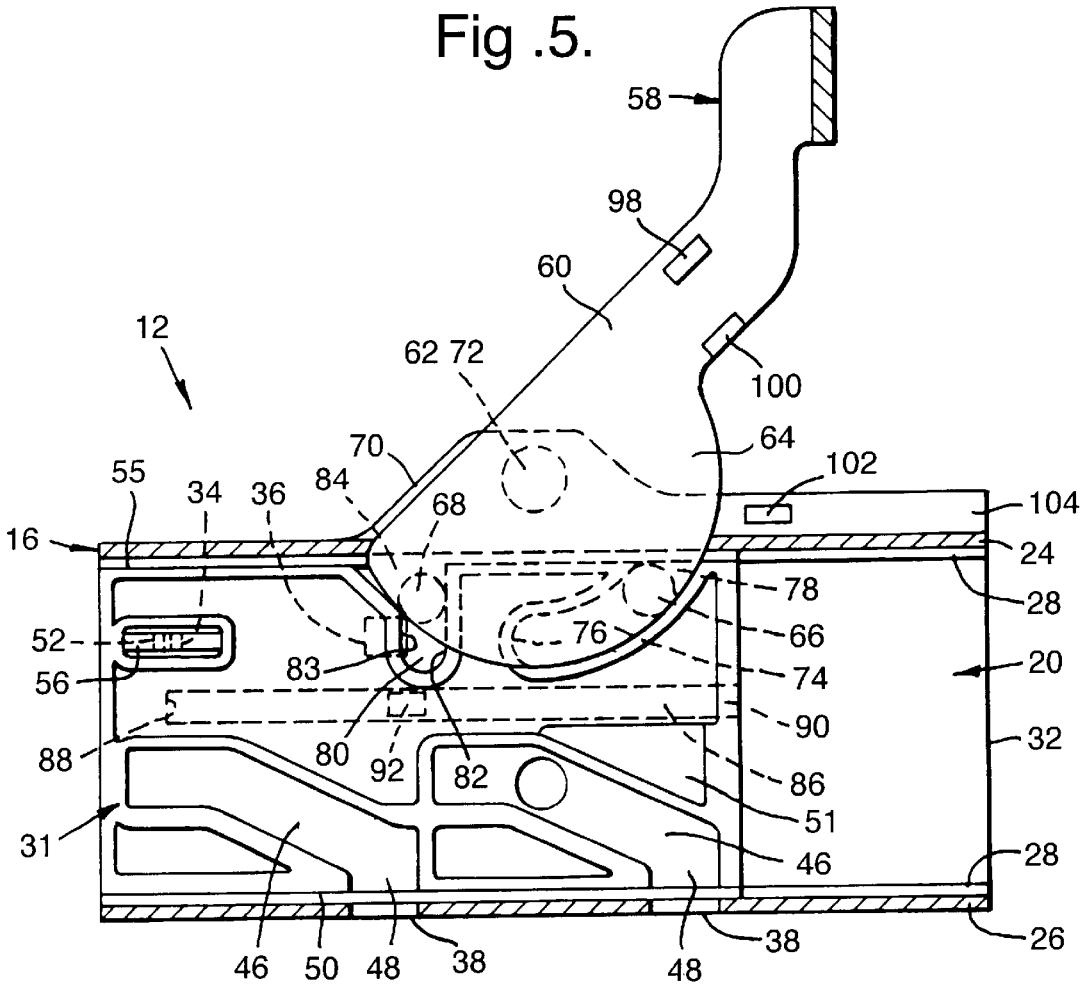
FIG. 5 is a similar view to that of FIG. 4 with the lever in an intermediate position.
Figure 6:
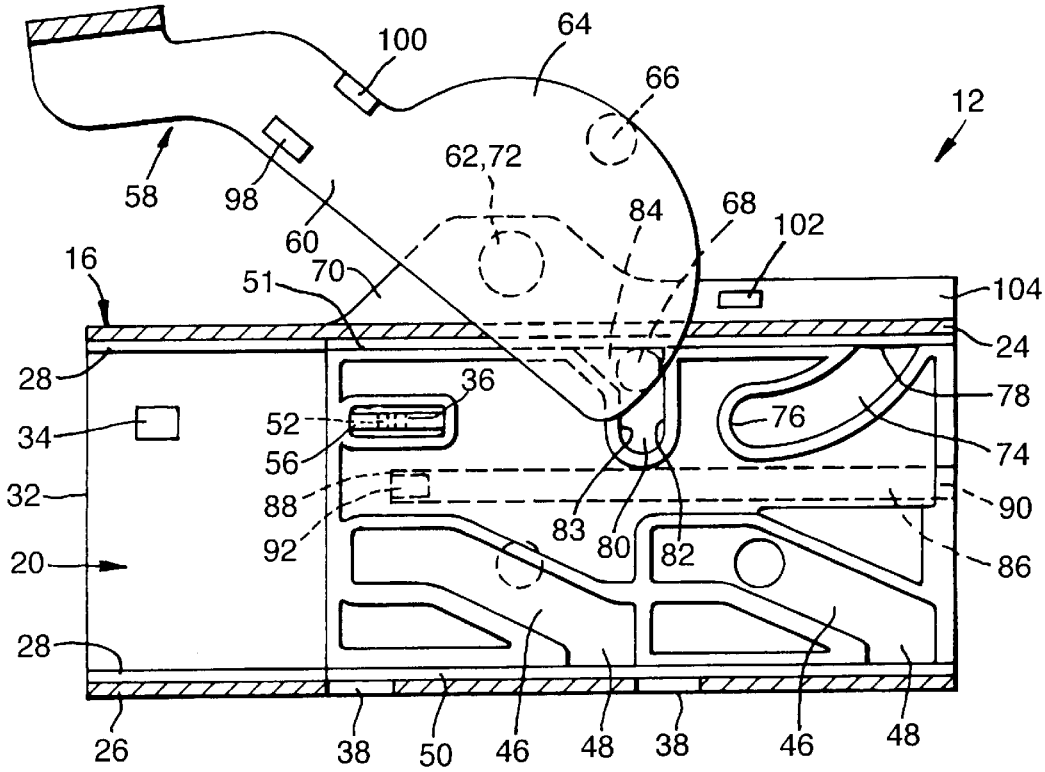
FIG. 6 is a similar view to that of FIG. 4 with the lever in fully mated position.

The connector 10 further comprises a substantially U-shaped lever 58. Each arm 60 of the lever 58 has a pivot pin 62 defining the centre of an arc-shaped portion 64 at the free end of each arm. The arc-shaped portion 64 has first and second pins 66,68 which are substantially equally radially spaced from the pivot pin 62. The upper wall 24 of each side wall 18,20 has an upward extension 70 (substantially centrally positioned in the direction Y) with a pivot aperture 72 formed therein which receives one of the pivot pins 62 with a snap fit. With this arrangement the lever 58 can pivot relative to the housing 16 about the pivot apertures 72 between an unmated position (FIG. 4) and a mated position (FIG. 6). In the unmated position of the lever 58, the first pin 66 of each arm 60 is positioned in a first channel 74 formed in internal surface 51 of the corresponding slider 30,31. The first channel 74 of each slider 30,31 is open sided and arc-shaped, and has a closed end 76 and an open end 78 which opens through the upper edge 55 of the slider 30, 31, shown in FIG. 5. In the mated position of the lever 58, the second pin 68 of each arm 60 is positioned in a second channel 80 formed as a slot in the internal and external surfaces 51,54 of the corresponding slider 30,31. The second channel 80 of each slider 30,31 is open sided, extends substantially in the direction of the mating axis X, has a first side edge 82 adjacent the closed end 76 of the first channel 74 and a second opposed side edge 83, and has an open end 84 which opens through the upper edge 55 of the slider 30, 31. As the lever 58 pivots relative to the housing 16 from the unmated position to the mated position, the first pin 66 on each arm 60 slides in its respective first channel 74 from the closed end 76 and leaves the first channel through the open end 78, and the second pin 68 enters the second channel 80 through the open end 84, slides in the second channel, and engages the first side edge 82. As the lever 58 pivots relative to the housing 16 from the mated position to the unmated position, the second pin 68 on each arm 60 slides in its respective second channel 80, engages the second side edge 83, and leaves the second channel through the open end 84, and the first pin 66 enters the first channel 74 through the open end 78, slides in the first channel, and engages the closed end 76. With this arrangement, the lever 58 drives (moves) the sliders 30,31 in the direction Y relative to the side walls 18,20. For all positions of the lever 58 between the unmated position and the mated position, at least one of the pins 66,68 is positioned in its respective channel 74,80, and for some positions of the lever, both pins are positioned in their respective channels, as shown in FIG. 5.

Figure 2:
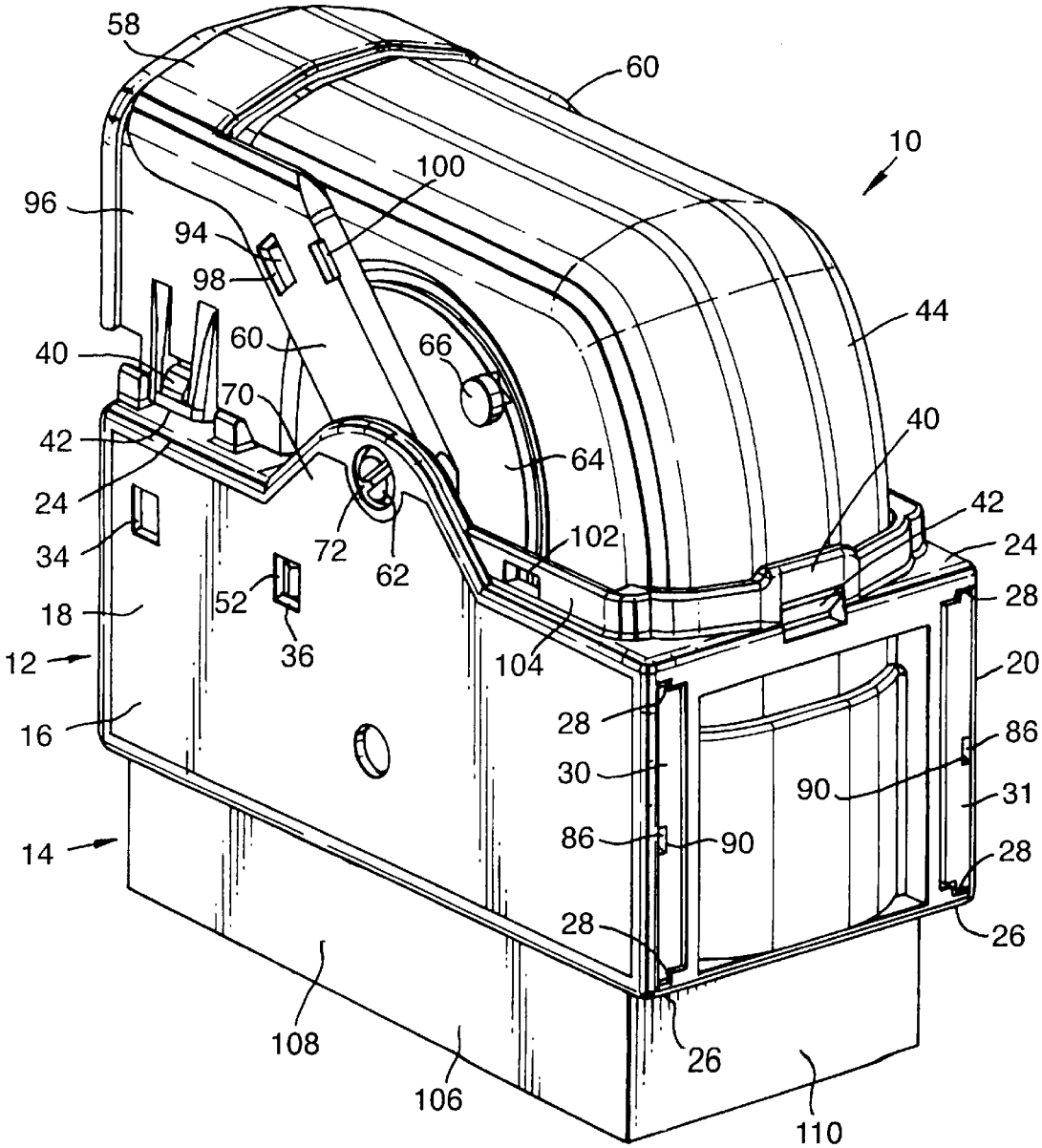
FIG. 2 is a perspective view of the connector of FIG. 1 with the lever in the fully mated position.

The cover 44 preferably includes a resilient latch tab 94 formed in each side wall 96 which makes a releasable snap fit with a corresponding shoulder 98 in each arm 60 of the lever 58 when the first and second parts 12,14 are fully mated (as shown in FIG. 2). Further, each arm 60 of the lever 58 preferably includes a resilient latch tab 100 which makes a releasable snap fit with a shoulder 102 formed in an upwardly extending wall 104 of the upper wall 24 of each side wall 18,20 when the lever is in the unmated position.

The second part 14 of the connector 10 has a housing 106 having side walls 108 and end walls 110. A pair of pins 112 is formed externally on each side wall 108. The pins 112 on each side wall 108 have the same spacing at the apertures 38 (shown in FIG. 4) in the lower wall 26 of the corresponding side wall 18,20 of the housing 16 of the first part 12. The side walls 108 and end walls 110 of the housing 106 of the second part 14 fit inside the side walls 18,20 and end walls 22 of the housing 16 of the first part 12. During mating and unmating, the pins 112 pass through the apertures 38 and slide along the inclined channels 46 formed in the sliders 30,31 in such a manner that the pins function as cam followers and the channels function as cam surfaces. The apertures 38 in first side wall 18 and the corresponding pins 84 preferably have a different spacing from the apertures 38 in the second side wall 20 and the corresponding pair of pins 112 for correct alignment and mating of the first and second parts 12,14.

Figure 3:
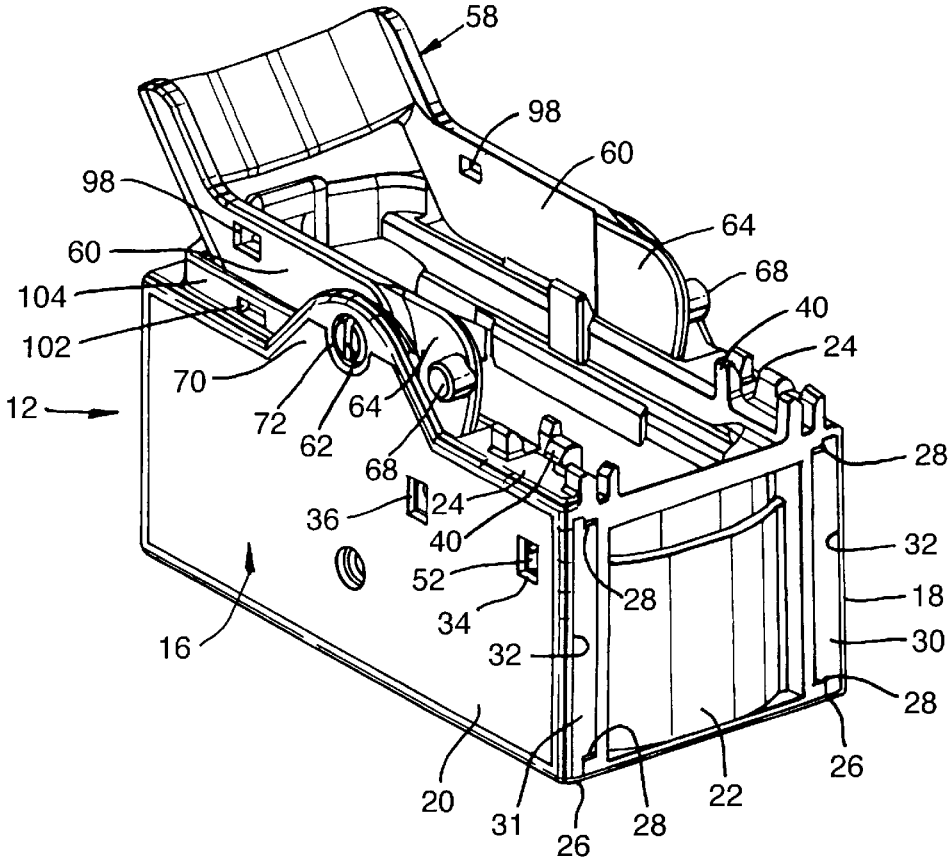
FIG. 3 is a similar view to that of FIG. 2 of the first part of the connector with the lever in the fully unmated position and the cover omitted.
Figure 4:
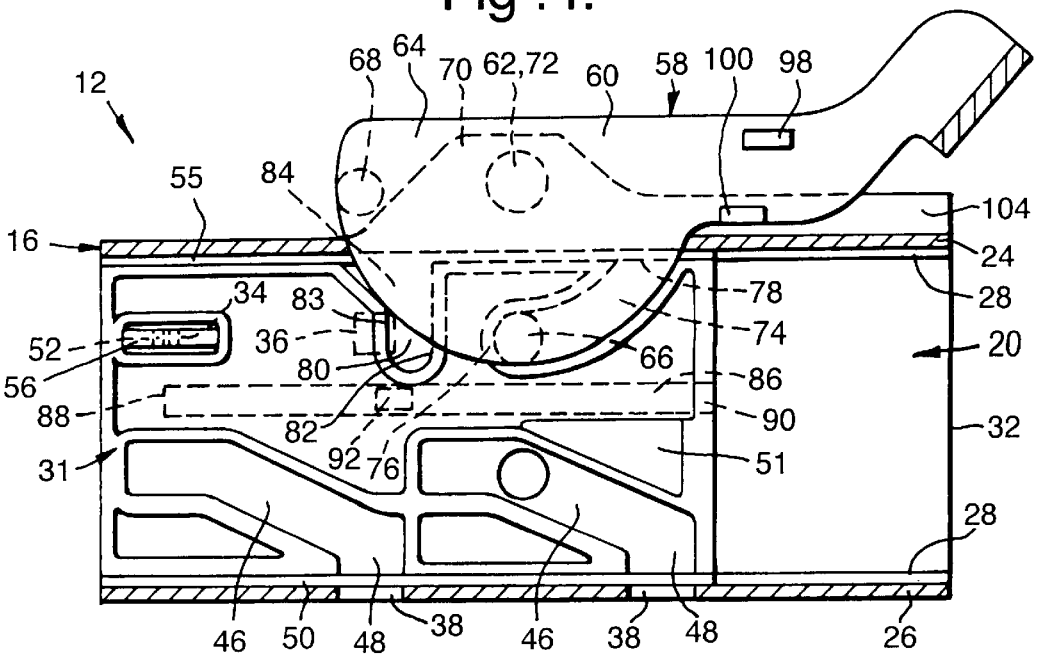
FIG. 4 is a cross-section view of the first part of the connector of FIG. 1 with the lever in the fully unmated position and the cover omitted.

Prior to mating, the lever 58 is moved to the unmated position shown in FIGS. 3 and 4. In this position of the lever 58, the tabs 52 on the sliders 30,31 make a snap fit in the first apertures 34 in the side walls 18,20 to substantially retain the sliders and the lever in this position and ensure alignment of the openings 48 in the inclined channels 46 with the apertures 38 in the lower walls 26 of the side walls. To further ensure the retention of the lever 58 in the unmated position, the tabs 100 on the lever makes a snap fit with the shoulders 102 on the upwardly extending wall 104 of the housing 16. The second part 14 of the connector 10 is then moved into position for mating, with the pins 112 on the housing 106 of the second part passing through the apertures 38 in the lower wall 26 of each side wall 18,20 of the housing 16 of the first part 12 and into the inclined channels 46 in the sliders 30,31. To mate the first and second parts 12,14, the lever 58 is pivoted relative to the housing 16 of the first part towards the fully mated position shown in FIGS. 2 and 6. During this pivoting movement of the lever 58, the tabs 100 on the lever are released from the shoulders 102, the tabs 52 on the sliders 30,31 are released from the first apertures 34 in the side walls 18,20, and the pins 112 on the housing 106 of the second part 14 are forced along the inclined channels 46 as the sliders 30,31 slide relative to the side walls 18,20 (along axis Y) of the housing 16 of the first part 12. This action moves the second part 14 in the direction of the mating axis X relative to the first part 12 to mate the first and second parts. When the first and second parts 12,14 become fully mated, the tabs 52 on the sliders 30,31 makes a snap fit in the second apertures 36 in the side walls 18,20 of the housing 16 of the first part 12 to substantially retain the first and second parts in the fully mated position. To further ensure the retention of the fully mated position of the first and second parts 12,14, the lever 58 then makes a snap fit with the latch tabs 94 on the cover 44. To unmate the first and second parts 12,14, the lever 58 is released from the latch tabs 94 and pivoted from the position shown in FIGS. 2 and 6 to the position shown in FIGS. 3 and 4 for reverse movement to that described above for mating of the first and second parts.

The slots 86 in the sliders 30,31 and the tabs 92 (shown in FIG. 4) in the side walls 18,20 ensure correct installation of the sliders in the housing 16 of the first part 12, and provide additional guidance for the sliders during movement of the sliders relative to the housing 16 of the first part 12. The shoulders 88 in the slots 86 act as a stop member which engages the tab 92 to prevent the sliders unintentionally leaving the housing 16. After installation of the sliders 30,31 in the housing 16 of the first part 12, the arms 60 of the lever 58 are attached to the housing 16 by making a snap fit between the pivot pins 62 and the pivot apertures 72, and the drive means between the lever and the sliders.

The pivot means of an aperture 72 and pin 62 may be reversed with the apertures in the arms 60 of the lever 58 and the pins on the upward extensions 70 of the side wall 18,20.

As well as the advantages mentioned above with respect to the prior art, the attachment of the lever 58 to an upward extension 70 of the side walls 18,20 allows a reduction in the overall size of the connector 10. Also, the use of a pair of pins 66,68 on each arm 60 of the lever 58, and corresponding channels 74,80 in each slider 30,31 for the drive means provides improved control during sliding movement, and the option of a longer slide distance.

What is claimed is:

1. An electrical connector (10) comprising a first part (12) mateable with a second part (14) along a mating axis, the first part including a housing (16) having opposed side walls (18, 20) and opposed end walls (22), each side wall having an upper wall (24) and a lower wall (26) defining opposed slide surfaces (28) extending perpendicular to the mating axis, first and second spaced apertures (34, 36) in each side wall, a pair of spaced apertures (38) in the lower wall of each side wall, and an upward extension (70) from the upper wall of each side wall; a slider (30, 31) positioned adjacent each side wall, each slider having an upper edge (55) and a lower edge (50) making a sliding engagement with the slide surfaces of the upper wall and the lower wall, respectively, of the side walls, a pair of inclined cam surfaces (46) having openings (48) in the lower edge alignable with the apertures in the lower wall of the side walls, and a resilient tab (52) for making a snap fit in the first aperture or the second aperture in the side wall; a substantially U-shaped lever (58) having a pair of arms (60); pivot means (62, 72) on each arm and each upward extension of each side wall to allow the lever to pivot relative to the housing of the first part; and drive means (66, 74; 68, 80) on each arm and each slider to slide each slider relative to the adjacent side wall on pivoting of the lever relative to the housing of the first part; the second part (14) including a housing (106) having side walls (108) and end walls (110) positionable inside the side walls (18, 20) and end walls (22) of the housing (16) of the first part (12), each side wall (108) of the housing (106) of the second part (14) having a pair of spaced cam followers (112) which can pass through the apertures (38) in the lower walls (26) and the openings in the inclined cam surfaces for sliding movement along the cam surfaces; pivoting movement of the lever moving the second part relative to the first part along the mating axis between a fully unmated position in which the tabs on each slider make a snap fit in the first aperture (34) in the side walls and a fully mated position in which the tabs on each slider make a snap fit in the second aperture (36) in the side walls (18, 20), and wherein the pivot means comprises a pivot aperture (72) in the upward extension (70) of each side wall (18,20) of the housing (16) of the first part (12) which makes a snap fit with a pivot pin (62) on each arm (60) of the lever (58).

2. An electrical connector as claimed in claim 1, wherein the cam surfaces in each slider (30,31) are defined by open-sided inclined channels (46), and the cam followers on the housing (106) of the second part (14) are defined by pins (112) formed on the side walls (108) of the housing.

3. An electrical connector as claimed in claim 1 or claim 2, wherein the tab (52) on each slider (30,31) is formed on the end of a resilient arm or on a resiliently flexible beam (56).

4. An electrical connector as claimed in claim 1 or claim 2, wherein slots (32) are formed in the housing (16) of the first part (12) between the end walls (22) and the side walls (18, 20) for installation of the sliders (30,31) into the housing.

5. An electrical connector as claimed in claim 1 or claim 2, wherein the first part (12) further comprises a cover (44) having a latch means (42), the latch means making a snap fit with a latch means (40) on the housing (16) of the first part.

6. An electrical connector as claimed in claim 5, wherein the cover (44) has a tab (94) on each side wall (96) of the cover which makes a snap fit with a shoulder (98) in each arm (60) of the lever (58) when the lever is pivoted to the fully mated position.

7. An electrical connector as claimed in claim 6 wherein each arm (60) of the lever (58) has a tab (100) which makes a snap fit with a shoulder (102) in an upwardly extending wall (104) of each side wall (18, 20) of the first part housing (16) when the lever is pivoted to the fully unmated position.

8. An electrical connector comprising:

a first part housing (16) having opposed side walls (18, 20), opposed end walls (22), and a mating axis, each side wall having an upper wall (24), a lower wall (26), a first spaced aperture (34), a second spaced aperture (36), a pair of spaced apertures(38), and an upward extension (70), the upper and lower wall (24, 26) defining the opposed slide surfaces (28), the slide surfaces (28) perpendicular to the mating axis, the first and second spaced apertures (34, 36) positioned through each side wall, the pair of spaced apertures (38) positioned through the lower wall of each side wall, and the upward extension (70) extending upward from the upper wall of each side wall;

a slider (30, 31) positioned adjacent each side wall, each slider having a first open-sided channel (74) having a closed end (76), a second open-sided channel (80) having side edges (82, 83), an upper edge (55), a lower edge (50), a pair of inclined cam surfaces (46) having openings (48), and a resilient tab (52), the upper and lower edge (55, 50) making a sliding engagement with the slide surfaces of the upper wall and the lower wall, respectively, of the side walls, the openings (48) located in the lower edge (50) alignable with the apertures (38) in the lower wall of the side walls, the resilient tab (52) aligned to make a snap fit in the first aperture (34) or the second aperture (36) in the side wall, the first channel extending arcuately from the upper edge (55) of the slider, the second channel extending parallel with the mating axis from the upper edge;

a U-shaped lever (58) having a pair of arms (60), each arm having a first pin (66) and a second pin (68), the first pin engaged slideably up to the closed end (76) of the first open sided channel (74) in each slider (30, 31), the second pin engaged slideably between the side edges (82, 83) of the second open-sided channel, the first and second pins (66, 68) for sliding each slider upon pivoting of the lever relative to the first part housing, the slider moving relative to the adjacent side wall, the sliding direction being perpendicular to the mating axis;

a pivot means (62, 72) on each arm (60) and each upward extension (70) of each side wall to allow the lever to pivot relative to the first part housing, the first and second pins radially spaced equally from the pivot means (62) on each arm; and a second part housing (106) mateable with the first part housing (16) along the mating axis, the second part housing (106) having side walls (108) and end walls (110) disposed inside the side walls (18, 20) and end walls (22) of the first part housing (16), each side wall (108) of the second part housing (106) having a pair of spaced cam followers (112) positioned to pass through the apertures (38) in the lower walls (26) and the openings in the inclined cam surfaces for sliding movement along the cam surfaces, pivoting movement of the lever moves the second part housing relative to the first part housing along the mating axis between a fully unmated position in which the resilient tabs (52) on each slider make a snap fit in the first aperture (34) in the side walls (18, 20), and a fully mated position in which the tabs on each slider make a snap fit in the second aperture (36) in the side walls (18, 20), wherein a first and second pins (66, 68) are on an arc-shaped portion (64) at the free end of each arm (60) of the lever (58).

9. An electrical connector comprising:

a first part housing (16) having opposed side walls (18, 20), opposed end walls (22), and a mating axis, each side wall having an upper wall (24), a lower wall (26), a first spaced aperture (34), a second spaced aperture (36), a pair of spaced apertures (38), an upward extension (70) and a tab (92), the upper and lower wall (24, 26) defining the opposed slide surfaces (28), the slide surfaces (28) perpendicular to the mating axis, the first and second spaced apertures (34, 36) positioned through each side wall, the pair of spaced apertures (38) positioned through the lower wall of each side wall, the upward extension (70) extending upward from the upper wall of each side wall, the tabs (92) positioned rigidly in opposition between the upper and lower wall (24, 26);

a slider (30, 31) positioned adjacent each side wall, each slider having a surface (54) facing the side wall (18, 20), an upper edge (55), a lower edge (50), a pair of inclined cam surfaces (46) having openings (48) in the lower edge, a resilient tab (52), and a slot (86) having an end (90) and a shoulder (88), the upper and lower edge (55, 50) engaged slideably with the upper and lower walls, respectively, of the side walls, the openings (48) alignable with the apertures (38) in the lower wall of the side walls, the resilient tab (52) aligned to make a snap fit in the first aperture (34) or the second aperture (36) in the side wall, the slot (86) formed in the surface (54) and perpendicular to the mating axis, the slot open at end (90) for receiving the tab (92);

a U-shaped lever (58) having a pair of arms (60);

a pivot means (62, 72) on each arm (60) and each upward extension (70) of each side wall to allow the lever to pivot relative to the first part housing;

a drive means (66, 74; 68, 80) on each arm and each slider to slide each slider relative to the adjacent side wall on pivoting of the lever relative to the first part housing;

a second part housing (106) mateable with the first part housing (16) along the mating axis, the second part housing (106) having side walls (108) and end walls (110) disposed inside the side walls (18, 20) and end walls (22) of the first part housing (16), each side wall (108) of the second part housing (106) having a pair of spaced cam followers (112), positioned to pass through the apertures (38) in the lower walls (26) and the openings in the inclined cam surfaces for sliding movement along the cam surfaces, pivoting movement of the lever moves the second part housing relative to the first part housing along the mating axis between a fully unmated position in which the resilient tabs (52) on each slider make a snap fit in the first aperture (34) in the side walls (18, 20), and a fully mated position in which the resilient tabs on each slider make a snap fit in the second aperture (36) in the side walls (18,20), and wherein the pivot means comprises a pivot aperture (72) in the upward extension (70) of each wall (18, 20) of the housing (16) of the first part (12) which makes a snip fit with a pivot pin (62) on each arm (60) of the lever (58).

* * * * *